US006494276B1

(12) United States Patent
Hamilton et al.

(10) Patent No.: US 6,494,276 B1
(45) **Date of Patent: *Dec. 17, 2002**

(54) ROCK AUGER WITH PILOT DRILL

(75) Inventors: Gary Wayne Hamilton, New Haven, KY (US); Charles Hamilton, Bardstown, KY (US)

(73) Assignee: Gator Rock Bits, Inc., Bardstown, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/684,821

(22) Filed: Oct. 10, 2000

Related U.S. Application Data

(63) Continuation-in-part of application No. 09/066,194, filed on Apr. 24, 1998, now Pat. No. 6,129,163.

(60) Provisional application No. 60/203,061, filed on May 9, 2000, and provisional application No. 60/185,664, filed on Feb. 29, 2000.

(51) Int. Cl.[7] ..... E21B 10/00; E21B 17/14

(52) U.S. Cl. ..... 175/403; 175/402; 175/320; 408/204; 408/238

(58) Field of Search ..... 175/385, 386, 175/402, 403, 404; 408/204, 206, 207, 238

(56) References Cited

U.S. PATENT DOCUMENTS

| | | | | | |
|---|---|---|---|---|---|
| 2,385,441 | A | * | 9/1945 | Hill | 175/404 X |
| 2,720,391 | A | * | 10/1955 | McCarthy et al. | 175/404 X |
| 3,360,025 | A | * | 12/1967 | Gallo, Sr. | 408/204 X |
| 3,388,949 | A | * | 6/1968 | Kozar | 175/404 X |
| 3,854,840 | A | * | 12/1974 | Miyanaga | 408/204 |
| 4,077,737 | A | * | 3/1978 | Morse | 408/206 |
| 4,078,622 | A | * | 3/1978 | Taylor-Myers | 175/404 |
| 4,101,238 | A | * | 7/1978 | Reibetanz et al. | 408/204 X |
| 4,228,862 | A | * | 10/1980 | Causse | 175/404 X |
| 4,671,367 | A | * | 6/1987 | Brunsing et al. | 175/58 |
| 5,061,126 | A | * | 10/1991 | Cain et al. | 408/206 |
| 5,145,017 | A | * | 9/1992 | Holster et al. | 175/404 X |
| 5,791,424 | A | * | 8/1998 | Moser et al. | 175/404 X |
| 6,116,827 | A | * | 9/2000 | Moser et al. | 408/204 |
| 6,129,163 | A | * | 10/2000 | Hamilton et al. | 175/403 |
| 6,123,230 | A1 | * | 4/2001 | Fuss | 175/385 X |
| D441,380 | S | * | 5/2001 | Hamilton et al. | D15/139 |

FOREIGN PATENT DOCUMENTS

| | | | | |
|---|---|---|---|---|
| DE | 3705717 | * | 9/1988 | 175/385 |

* cited by examiner

*Primary Examiner*—Jong-Suk (James) Lee
(74) *Attorney, Agent, or Firm*—Carrithers Law Office; David W. Carrithers

(57) ABSTRACT

A rock auger for drilling postholes through rock without the use of hydraulic pressure and at a slow rate of revolutions per minute can function utilizing only the weight of the auger, shaft, and/or boom providing a floating auger to reduce shock and vibration stress on the auger, boom, and drive unit. It does not require any additional hydraulic pressure for cutting a circular hole through the rock and forming a plug which is to be lodged in the cavity of the rock auger cylinder to be removed from the posthole. A quick connection shaft enables the conventional flighted auger to be quickly substituted for the rock auger to facilitate fast removal of soft dirt from the posthole. A center drill bit can be disposed within the cutting head for extending outwardly pass the cutting edge thereof for starting the hole, breaking up rock, and holding the auger in position guiding it during the drilling operation. A section or portion of the cutting head extending from the cutting edge upward a selected distance to as far as the upper edge of the cutting head may be removed providing access and quick removal of the plug formed therein.

33 Claims, 8 Drawing Sheets

ROCK AUGER WITH PILOT DRILL

This is a Continuation-In-Part of U.S. application Ser. No. 09/066,194 filed on Apr. 24, 1998 now U.S. Pat. No. 6,129,163 which is incorporated by reference herein, and claims priority from U.S. Provisional Applications Serial No. 60/203,061 filed on May 9, 2000 and Ser. No. 60/185,664 filed on Feb. 29, 2000.

BACKGROUND OF THE INVENTION

The present invention relates to a flightless rock auger suspended from a derrick and powered by a shaft linked to a power source for removing plugs of rocks from post holes.

Poles for power lines and communication purposes are required to be vertical and arrange din straight lines. The poles may be planted in positions which are relatively inaccessible. A crane may be utilized for providing an outreaching means. Typically a digger derrick consists of a telescopic mobile crane from which is suspended a torque head. A flighted auger is suspended from the torque head and utilized for drilling in soil containing loose rock. The digger derrick is advantageous for extending the auger to the desired location. The auger may be stowed in a fixed position or extended in a telescoping position as needed to reach the desired location for drilling the hole.

Depending on the nature of the digging device, its digging element, or auger, torque head or hydraulic pressure is typically exerted on the digging element via air or oil hydraulic pressure exerted by the crane or cylinder in cooperative engagement therewith for forcing the digging element into the earth.

Although the conventional flighted auger is adequate for drilling through soil, or even soil with loose rock, the drilling operation must be suspended upon hitting a large rock or rock ledge because the flighted auger cannot penetrate the hard rock surface. The flighted auger is then lifted out of the hole and conventional methods of removing the obstruction with a steel shaft, crowbar, or explosive charge are used to break-up the hard rock. The flighted auger is then lowered back into the hole to remove the loose rock.

A considerable amount of time is lost during the rock break-up and removal procedure. Moreover, an effort is continually being made to minimize work with explosives due to the liability of injury to workers and/or damage to residents or businesses in the area which may be in the area of the blasting zone and susceptible to rock or vibration damage.

SUMMARY OF THE INVENTION

The present invention achieves the above objects by providing a flightless rock auger for drilling postholes through rock and hardpan.

The flightless rock auger is used for drilling postholes through rock without the use of hydraulic pressure and at slow revolution per minute. The rock auger is used in combination with a conventional flighted auger used for drilling postholes in dirt and clay. During a posthole drilling operation, the rock auger is substituted for a conventional flighted auger as needed for drilling through and removing rock or other hard material such as concrete from the posthole. The rock auger is designed for use at very low revolutions per minute and can function utilizing only the weight of the auger and shaft and does not require any additional hydraulic pressure for cutting a circular hole through the rock and forming a plug which is to be lodged in the cavity of the rock auger cylinder to be removed from the posthole. The quick connection shaft enables the conventional flighted auger to be quickly substituted for the rock auger to facilitate fast removal of soft dirt from the posthole. Moreover, one or more slots can be formed in the coupling connecting the auger shaft to the drive shaft of the power unit in providing a limited amount of play or movement enabling the rock auger to float if desired and reduce shock and vibration to the drive unit. A center drill bit can be disposed within the cutting head for extending outwardly pass the cutting edge thereof for starting the hole, breaking up rock, and holding the auger in position during the drilling operation. A portion of the cutting head extending from the cutting edge upward a selected distance to as far as the upper edge of the cutting head may be removed providing access and quick removal of the plug formed therein.

The present invention provides a flightless rock auger having a cylindrical hollow cutting head and a plurality of teeth extending from the lower periphery thereof. A support member extends across a portion of the cylindrical hollow cutting head providing a means for cooperative engagement with a shaft extending outwardly therefrom. A quick disconnect coupling is disposed upon the distal end of the shaft.

A preferred embodiment of the flightless rock auger system for use with a drilling rig includes a flightless rock auger having a cylindrical hollow cutting head with a plurality of cutting teeth extending from the bottom edge of the cutting head. A support member extends across a portion of the cylindrical hollow cutting head providing a means for cooperative engagement with a vertical drive shaft extending outwardly therefrom. A quick disconnect coupling is disposed upon the distal end of the shaft. A means for rotating the drive shaft such as a mechanical or fluid drive may also power the hydraulic mechanism for lifting and lowering the drive shaft which utilizes its own weight for exertion of downward pressure onto the hard substrate. Of course, it is contemplated that the weight of the boom or hydraulic pressure may be provided if available to increase the rate of drilling without damaging the rock auger.

A method of removing hard substrate from a posthole, using a flightless rock auger with a drilling rig simply requires the attaching a flightless rock auger having a cylindrical hollow cutting head and a plurality of cutting teeth extending from the bottom edge of the cutting head. A support member extends across a portion of the cylindrical hollow cutting head providing a means for cooperative engagement with a vertical drive shaft extending outwardly therefrom. A quick disconnect coupling is disposed upon the distal end of the shaft to means for rotating the drive shaft. The flightless rock auger is lowered into a posthole containing a hard substrate and resting the flightless rock auger onto the hard substrate. The auger is rotated at a very low rpm typically less than 20 revolutions per minute (rpm) and preferably less than 10 rpm, usually from about 3 rpm to about 10 rpm forming a plug of hard substrate inside of the cylindrical body of the flightless rock auger. Lifting the flightless rock auger and the plug from the posthole is simple and the plug of the hard substrate is removed from the flightless rock auger head. The flighted auger is then substituted for removing soil from the posthole.

The flightless rock auger comprises a cylindrical head defining a plurality of teeth extending downwardly from the periphery of the bottom edge at a selected forward angle. The top of the head is connected to a shaft having a quick disconnect adapter on the opposing distal end.

The rock auger is utilized in combination with a conventional flighted auger used for drilling postholes in dirt and clay. During a posthole drilling operation, the rock auger is substituted for the flighted auger when needed to drill through and remove rock or other hard material such as concrete from the posthole. The rock auger is designed for use at very low revolutions per minute and utilizes only the weight of the auger and shaft and does not require any additional hydraulic pressure for cutting a circular hole through the rock and forming a plug which is be lodged in the cavity of the rock auger cylinder to be removed from the posthole. The quick connection shaft enables the conventional flighted auger to be quickly substituted for the flightless rock auger to facilitate fast removal of soft dirt from the posthole. The rock auger provides a means for utility companies to utilize a means for drilling postholes for electric poles, telephone poles, pilings, and the like without the use of explosives; thereby providing a safer means of excavation.

When the drilling operation encounters rock, rather than blasting through the rock with explosives, or calling a truck utilize a pressurized auger with flights, the non-pressurized flightless rock auger can be fitted onto the torque head of a conventional drilling shaft and used to drill through the rock. A plug may be formed in the head by the drilling operation; however, the plug is removed by using had tools which fit into openings formed in the top end of the drilling head.

A preferred embodiment of the present invention defines a flightless rock auger for removing plugs of hard material from post holes. The rock auger includes a cylindrical hollow cutting head having a hollow cylindrical body defining side walls connecting a top end defining an upper peripheral edge and a lower open end defining a lower peripheral cutting edge including a plurality of teeth extending from the lower peripheral edge. The top end of the hollow cylindrical body includes at least one support member extending across at least a portion of the top end joining the side walls. A shaft having a diameter less than the cutting head includes a proximal end connecting to the at least one support member and having an opposing distal end extending therefrom. A quick disconnect coupling disposed upon the opposing distal end of the shaft includes means for a floating attachment to a drive shaft of a power unit providing limited vertical movement therebetween.

Moreover, the power drive shaft of the auger drive unit can also be connected to the shaft of the auger by a coupling which limits or even eliminates any "play" and provide a tight cooperative engagement therebetween. The auger and cutting head will still "float" in that only the weight of the auger will be necessary to cut through the rock substrate. If desired the cutting may be faster by also letting the power drive boom weight rest on the auger thereby floating on the rock substrate during the drilling process. Of course, applying downward pressure to the auger by use of the boom is an option; however, unnecessary to obtain good performance.

Accordingly, it is a principal object of the present invention to provide a flightless auger device for digging through hard rock.

It is another object of the present invention to provide an flightless auger which is capable of drilling through rock and forming a plug removable from the flightless auger.

It is another object of the present invention to provide a flightless auger utilizing an attachment means which is interchangeable with the attachment means typically used with conventional flighted augers for drilling operations.

It is therefore another object of the present invention to design a flightless auger for use at very low revolutions per minute (rpm) to maximize safely and prevent damage to the equipment.

It is an object of the present invention to provide an adapter extending from a shaft for use with a torque head of a drilling derrick.

Another object is to provide a flightless auger having teeth extending outward at a forward angle.

It is another object to provide a flightless auger having a drill head portion utilizing an end diameter of greater diameter than the plug receiving inner diameter.

It is yet another object of the present invention to utilize a plurality of diagonal ribs to minimize suction between the exterior of the drilling head and the walls of the drilled hole.

It is yet another object of the present invention to provide an access port in the top end of the drilling head for removal of the rock plug formed therein.

The rock auger provides an alternative method for utility companies to drill postholes for electric poles, telephone poles, pilings, and the like without the use of explosives thereby providing for safer excavation.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF THE PREFERRED EMBODIMENT

Figure 3:
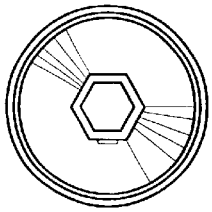
FIG. 3 is a top view of the invention of FIG. 1.

The nonpressurized flightless rock auger 10 with quick attachment coupling 11 of the present invention is manufactured from readily available materials and simple in design. The preferred embodiment is comprised of metal, more particularly steel. The rock auger 10 is mounted on construction equipment such as hydraulic drilling rigs. A drive shaft 12 in communication with a drilling rig motor 14 or circulation of a hydraulic fluid from a pump on the drilling rig 16 may be used to drive the hydraulic motor 18 of the construction equipment.

Referring now to the drawings, FIGS. 1–8 refer to the present invention including a standard drive shaft 12 utilizing a quick disconnect coupling 11 extending from the distal end 13 of the shaft 12. The shaft 12 is centrally aligned with the axis of the hollow cylindrical body 20 and secured to the proximal end, or top end of the cutting head 24 opposite the open end 26 having the cutting edge. The top end is at least partially enclosed by a cross member 21 to provide structural strength. One or more reinforcements member such as the triangular members 28 may be welded to the shaft 12 and the top cross member 21 of the cutting head 24 to provide additional lateral and rotational strength.

Figure 4:
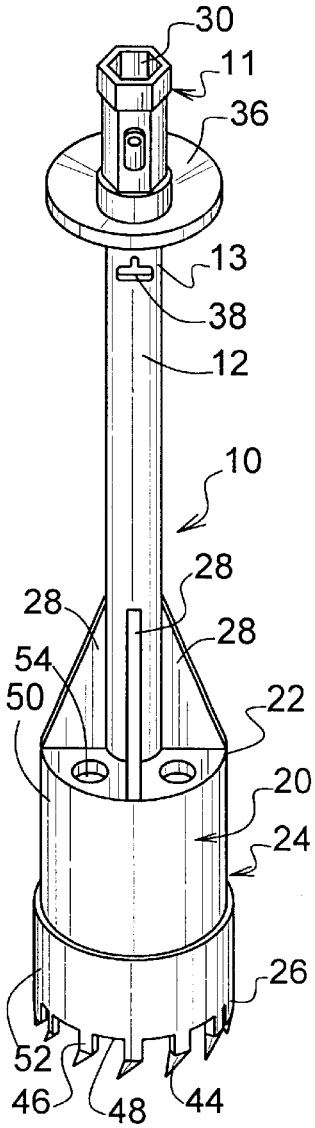
FIG. 4 is a perspective view of the invention of FIG. 1.
Figure 1:
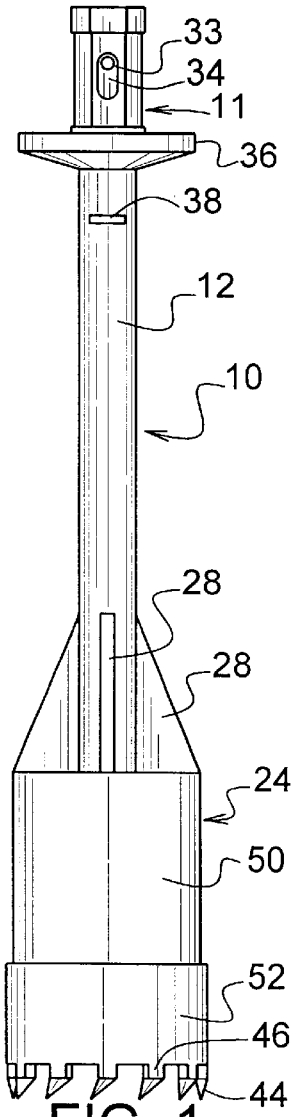
FIG. 1 is a front perspective view of the present invention showing the shaft with a quick disconnect distal end, a cylindrical body and drill head having a greater diameter than the body wherein a plurality of teeth extend downward at an angle from the outer edge of the drill head.
Figure 2:
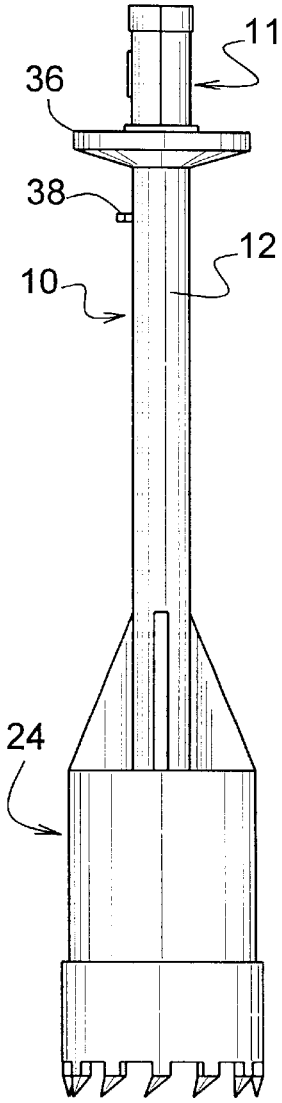
FIG. 2 is a side perspective view of the invention of FIG. 1.
Figure 5:
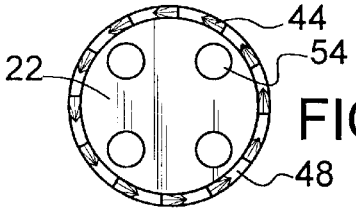
FIG. 5 is a bottom view of the invention of FIG. 1.
Figure 6:
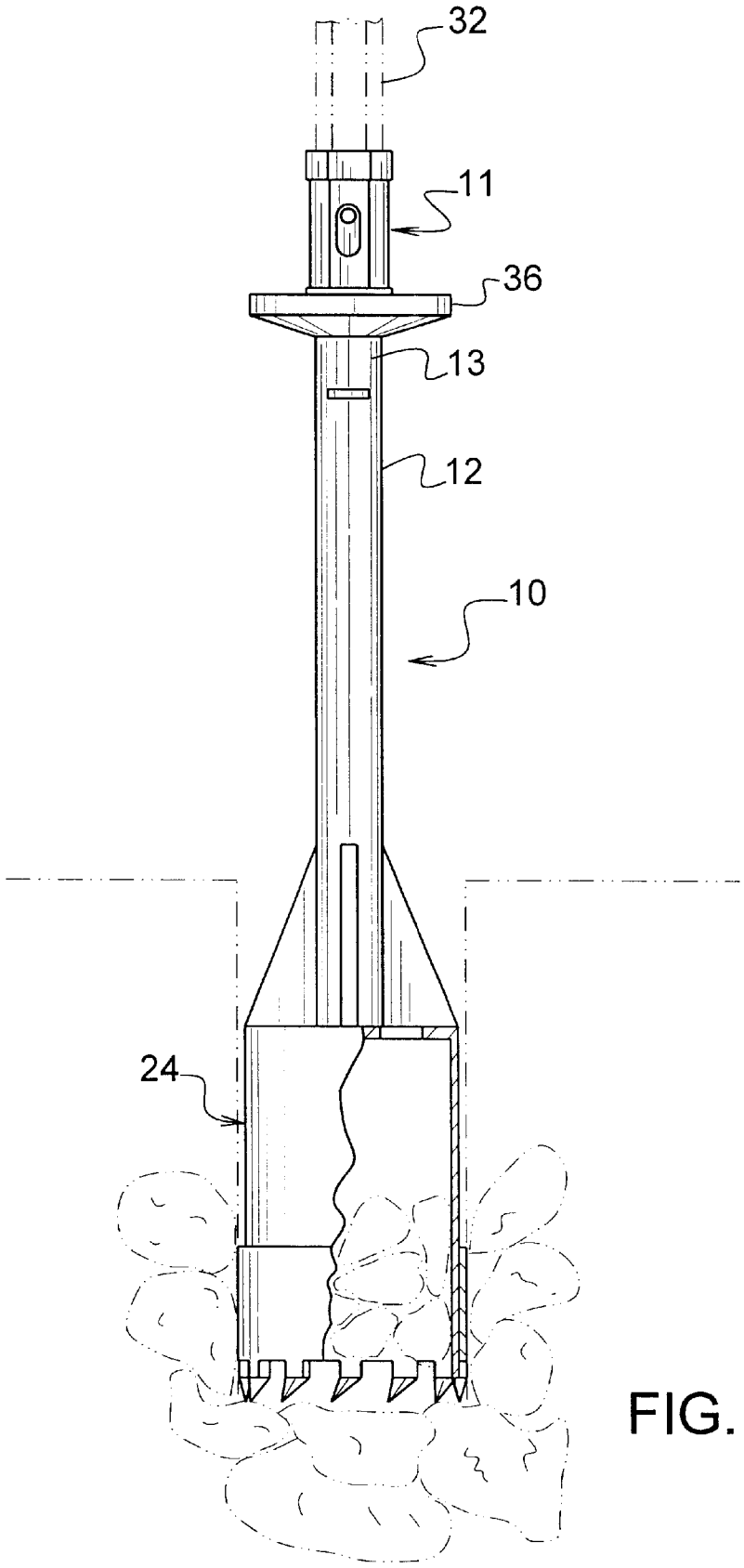
FIG. 6 is a partial cutaway view of the invention of FIG. 1 shown drilling through rock forming a plug therein.
Figure 7:
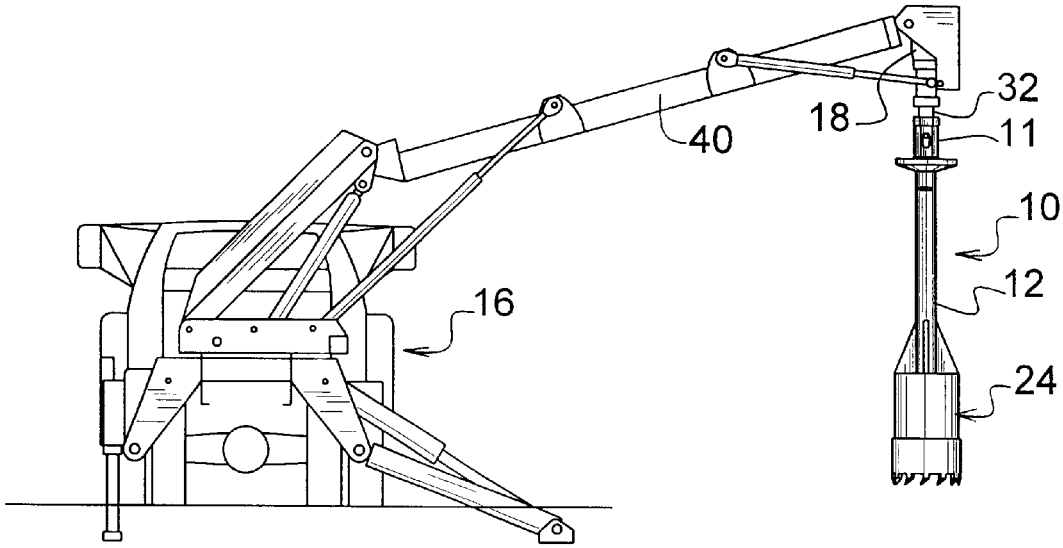
FIG. 7 is a perspective view of an embodiment of a mobile drilling rig utilizing the present invention.
Figure 8:
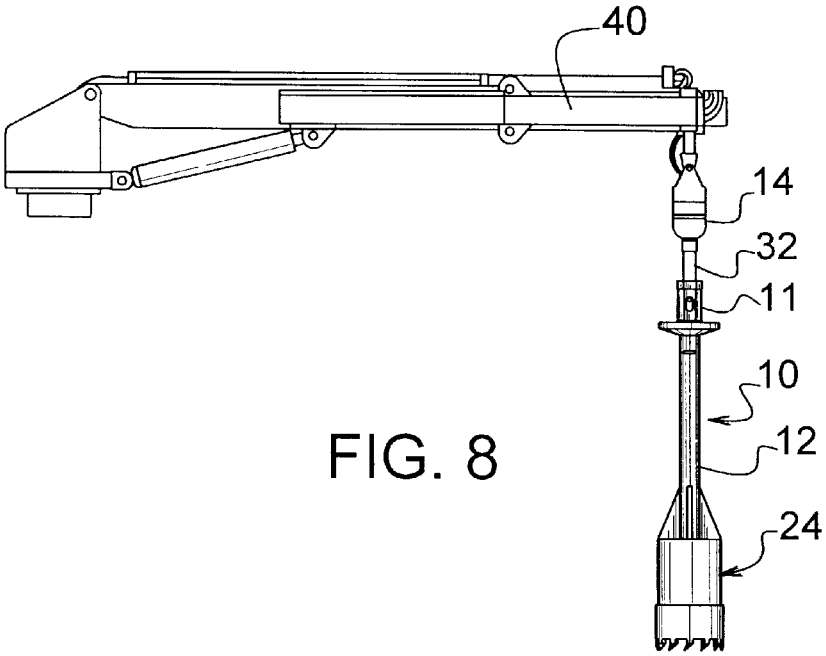
FIG. 8 is a perspective view of another embodiment of a life assembly suspending the present invention above the ground.

As shown in FIGS. 3 and 4, the distal end 13 of the shaft 12 is typically tubular having a circular cross-sectional dimension, wherein a quick disconnect cylindrical coupling 11 may be welded, pressed, screwed, or friction fitted to the distal end 13 of the shaft 12. The cylindrical coupling 11, preferably is shaped having a female socket end 30 for cooperative engagement with the male end of a drive shaft 32 of a motor 14 or pump drive unit 18. A pin 33 may extend through the female socket end 30 and drive shaft 32 to provide the cooperative engagement; however, the preferred embodiment utilizes a coupling having a female socket end 30 sized and having a selected cross-sectional shape, to mate with a male drive shaft 32 having a square, hexagon, octagon or other shape for providing additional stability, rigidity, and stability to the connection therebetween. Moreover, the preferred embodiment includes a pin 33 which slides through a vertically disposed key way slot 34 to secure the quick connect coupling 11 to the drive shaft 32 of the drilling rig 16 permitting limited vertical movement therebetween as best shown in FIG. 3. A protective collar or flange 36 may extend circumferentially around the coupling 11. A key 38 may be inserted into a groove or orifice in the shaft 12 to provide an alignment indicator so that a user standing below the drilling boom 40 can look upward and align the key way slot 34 of the rock auger with the key way of the pump motor drive shaft 32 for quick coupling of the units. The key 38 also provides an easy means to count the revolutions per minute of the auger 10.

The cutting head 24 is formed from a hollow cylindrical body 20 open at its lower open end 26. A plurality of conical shaped teeth 44 extend from generally rectangular shaped projections 46 extending from the outer peripheral edge 48 of the cutting head body 20. The conical shaped teeth 44 are equally spaced apart and angled slightly in a forward direction. The teeth 44 may also be angled inwardly or outwardly slightly to protrude pass the peripheral edge 48 of the hollow cylindrical body 20. For instance, the series of teeth 44 at the bottom edge of the hollow cylindrical body 20 may be alternately inwardly and outwardly displaced from the plane of the hollow cylindrical body 20. The displacement of the teeth 44 is such that the cut or kerf made in the rock or other hard substrate is slightly wider than the thickness of the hollow cylindrical body 20 to aid in extraction of the cutting head 24 from the hard substrate for the invention as set forth in the embodiments shown in FIGS. 1–15. The teeth 44 may also be provided with additional material so that each tooth is wider than the thickness of the side walls of the hollow cylindrical body 20.

One preferred hollow cylindrical body embodiment comprises an upper section 50 and lower section 52, wherein the lower section 52 defines a greater exterior diameter than the upper section 50 to facilitate removal of the cutting head 24 from the posthole and reduce or prevent binding during the drilling process. Moreover, a hole, slot, slit or other opening 51 is optionally cut or formed into the upper section 50 to allow water to exit the head during the cutting operation and avoid causing a suction making removal of the rock plug difficult.

The flightless auger 10 is designed for interchangeable use with a conventional flighted auger used for removal soil from the post holes. The quick disconnect feature of the flightless auger 10 makes the interchangeable augers practical to use together without wasting time. Upon hitting a hard substrate such as a rock ledge, the flighted auger can be disengaged in minutes and the flightless rock auger 10 attached to the drilling rig. The flightless auger 10 is lowered and raised with the hydraulic boom so that only the weight of the auger 10 exerts pressure on the rock substrate defining floating pressure. Although it is conceivable that pressure may be exerted on the auger 10 it is not necessary in that the weight of the auger 10 is sufficient to cut through hard material such as rock ledges. Usually it is sufficient to lower the flightless rock auger 10 into the hole and letting it rest or "float" on the hard substrate. Optionally the weight of the power unit and boom may rest on the auger 10 adding additional weight; however, the auger is still considered to "float" in that no hydraulic pressure is needed to cut through the rock. Because the auger 10 is operated at a very low rpm, typically up to 15 revolutions per minute, ("rpm"), and preferably about 3 to 10 rpm, little dust is formed in the operation. Moreover, the wear and tear on the equipment is reduced if not eliminated as compared with the conventional drilling methods. This provides a very safe method of forming a plug of material within the cylindrical cutting head 24 for removal from the posthole. Upon breaking through the hard substrate and forming a plug therefrom, the flightless rock auger 10 is lifted from the hole and the plug removed by prying the plug out of the cylindrical body 20 with the use of pry bars which are extended into the openings 54 in the top of the cylindrical cutting head 24 or openings which may be formed in the cylindrical body.

Figure 9:
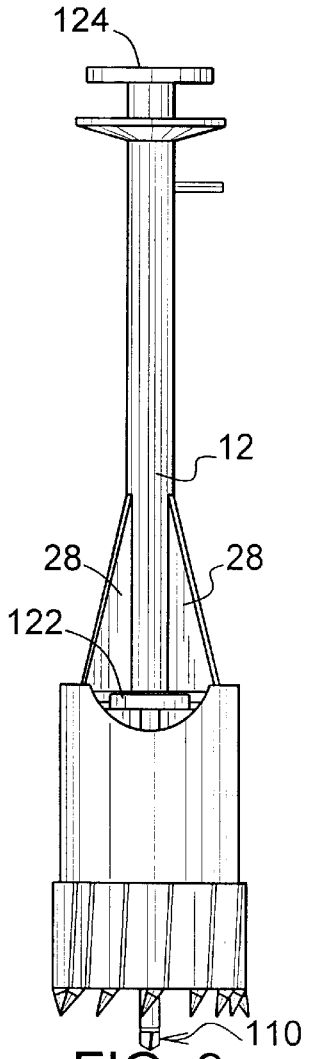
FIG. 9 is a front perspective view of the present invention showing the shaft with a quick disconnect distal end, a cylindrical body and drill head having a greater diameter than the body wherein a greater number of teeth extend downward at an selected angle from the outer edge of the drill head, and a center pilot bit having a base attached to the support member, cutting head, and the shaft, whereby the center pilot bit is in spaced apart alignment with the sidewalls of the cutting head and extends below the teeth of the cutting edge.

FIG. 9 is an alternate embodiment showing a cutting head of a flightless auger having a row of removable conical teeth extending from the bottom edge of angled sockets mounted by welding onto the bottom of he cutting head, whereby the sockets and teeth are oriented in a staggered configuration with teeth angled forward at from 20 to 50 degrees and preferably about 35 degrees, wherein every third tooth is angled up to 30 degrees in the horizontal plane outwardly pass the edge of the cutting head, angled up to 30 degrees in the horizontal plane inwardly pass the edge of the cutting head, or in alignment with the edge of the cutting head, and wherein the support member connecting the side walls of the upper portion of the cutting head includes means for attachment defining a pair of bolts extending therethrough. Moreover, FIG. 9 shows a pilot bit 110 centrally disposed and extending through the cylindrical upper body and even with or past the cutting teeth 44.

Figure 11:
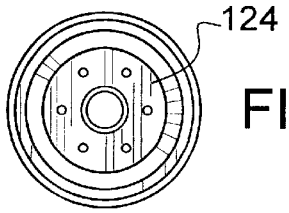
FIG. 11 is a top view of the invention of FIG. 9.
Figure 10:
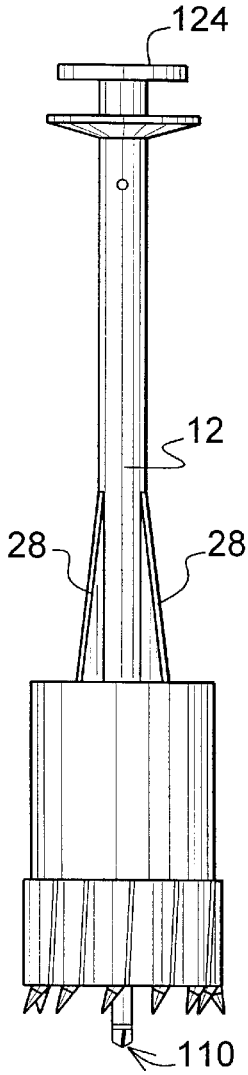
FIG. 10 is a side perspective view of the invention of FIG. 9.

FIG. 10 shows the cutting head of the auger of FIG. 9, including a center drill bit or pilot bit 100 having a base 102 is attached to the support member and the shaft 104 of the center drill bit is in spaced apart alignment with the sidewalls of the cutting head. Moreover, the teeth in the cutting head are disposed at an angling 20 degrees in and out from the sidewall edge and being disposed at from 70 to 75 degrees and preferably at about 73 degrees at a forward angle;

As shown in FIG. 11, the shaft 104 of the center drill bit which can be formed as a single cylindrical longitudinal member or as a longitudinal member including a plurality of tapered support plates 106 (two or three or four or more) extending from the base and attaching to a point or preferably welded all along the vertical edge to the shaft end at a point near the drill tip where the tapered ends of the support plates shaft ends in a short cylindrical collar 111 having a thicker bottom portion 113 of a larger diameter than the elongated top portion 115 which includes a threaded bore 108 therein for cooperative engagement with a drill tip 110 having a complementary sized shaft 112 and a drill head 114 including angled edges 116 and a pointed tip 118 for cutting into hard surfaces such as rock. The drill base 102 includes holes formed therein for attachment to bolts extending through the cutting head support member.

Figure 12:
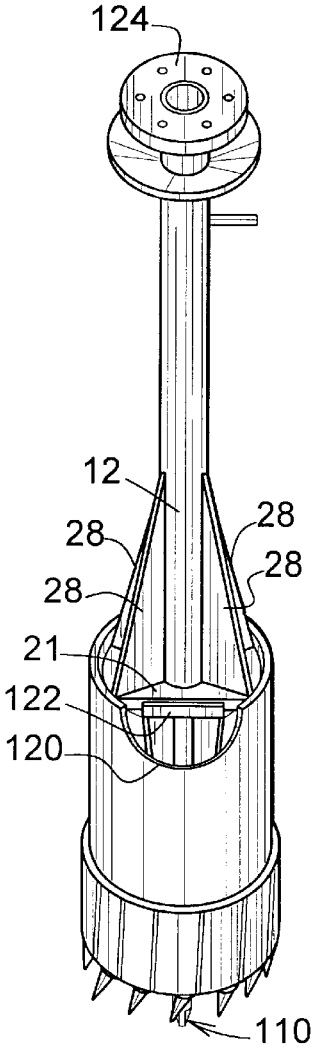
FIG. 12 is a perspective view of the invention of FIG. 9.
Figure 13:
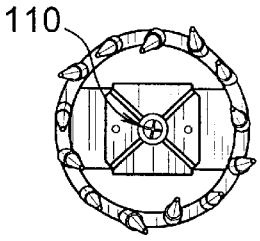
FIG. 13 is a bottom view of the invention of FIG. 9.

As illustrated in FIGS. 12 and 13, the pilot drill bit 100 mounted within the cutting head of the auger wherein the elongated top portion of the collar extends outward pass the cutting head approximately equal with the tips of the cutting head teeth. The pointed tip 118 extends pass the cutting teeth for centering and holding the auger in position in order for the cutting teeth to anchor and cut a precision hole into the hard rock substrate. The pilot drill bit 100 also provides a means for setting the flightless auger onto a flat hard rock surface. The pilot drill bit 100 cuts a center hole in the surface anchoring the flightless auger so that the cutting teeth are pulled or can cut into the substrate forming a neat round hole in the desired location rather than skidding or walking around on the surface before the hole sidewalls are established. The auger and drill bit are shown wherein the front end of the rock auger having the drill bit is mounted therein.

Moreover, FIG. 13 is a bottom view of the invention of FIG. 9 view of a cutting head incorporating 18 teeth on an 18 inch diameter auger vs. 13 teeth on the initial embodiment of the invention providing a smoother cutting operation and smoother sidewalls on the hole formed thereby. Also, the cutting teeth are disposed at an angle extending inwardly and outwardly at 20 degrees which varies from the original embodiment, finally the cutting teeth are mounted in a range of from 70 to 75 degrees and preferably at about 73 degrees facing forward.

Figure 15:
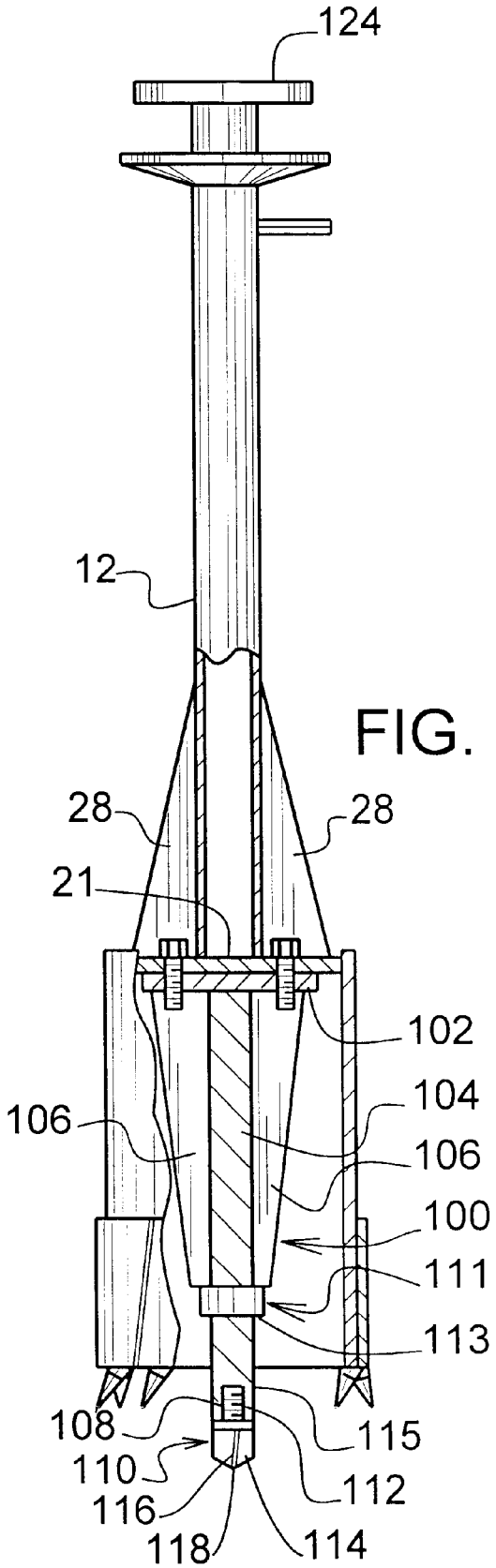
FIG. 15 is a cut-away perspective view of the rock auger shown in FIG. 9.
Figure 18:
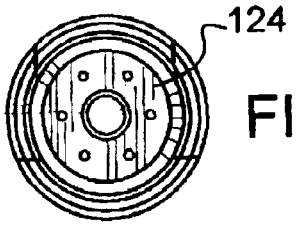
FIG. 18 is a top view of the invention of FIG. 16.
Figure 19:
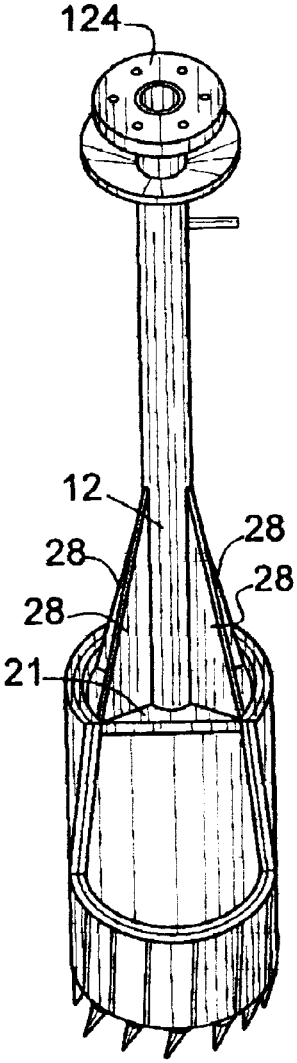
FIG. 19 is a perspective view of the invention of FIG. 16 showing the double layer sidewall which may be optionally utilized to form a cutting edge on the side of the cutting head and whereby the cylindrical body may be sized to be smaller than or as large as the cutting head.
Figure 16:
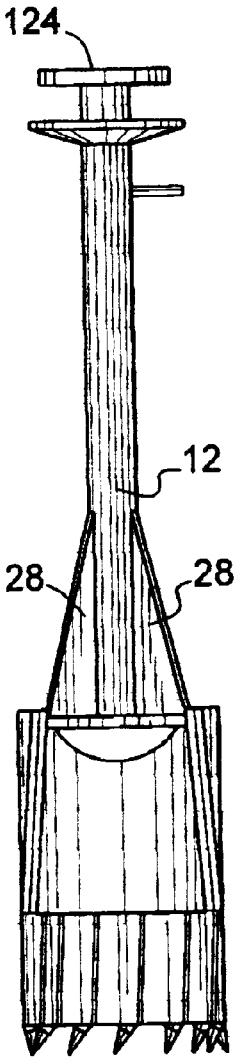
FIG. 16 is a front perspective view of the present invention showing the shaft with a quick disconnect distal end, a cylindrical body and drill head having a greater diameter than the body wherein a greater number of teeth extend downward at an selected angle from the outer edge of the drill head, and a section of the cutting head has been removed to facilitate removal of the plug.
Figure 17:
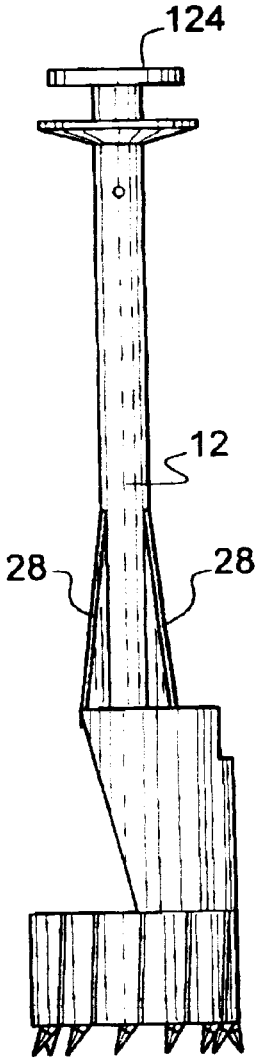
FIG. 17 is a side perspective view of the invention of FIG. 16.
Figure 20:
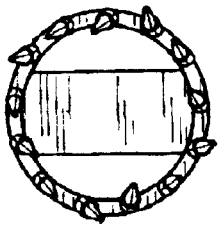
FIG. 20 is a bottom view of the invention of FIG. 16.

FIG. 15 shows the bottom of the support member connecting the side walls at the top of the cutting head having a plurality of tapered support plates attaching to the bottom of the cutting head support plate and the base of the drill bit 100 extending opposite thereof concentrically within the cutting head, and the cutting head having cutaway portions forming opposing openings 120 in the top portion of the cutting head cylindrical body and extending from the corners of the cutting head support plate for providing access to the bolts for removal of the cutting drill bit and removal of the rock substrate plug from the cutting head.

Figure 14:
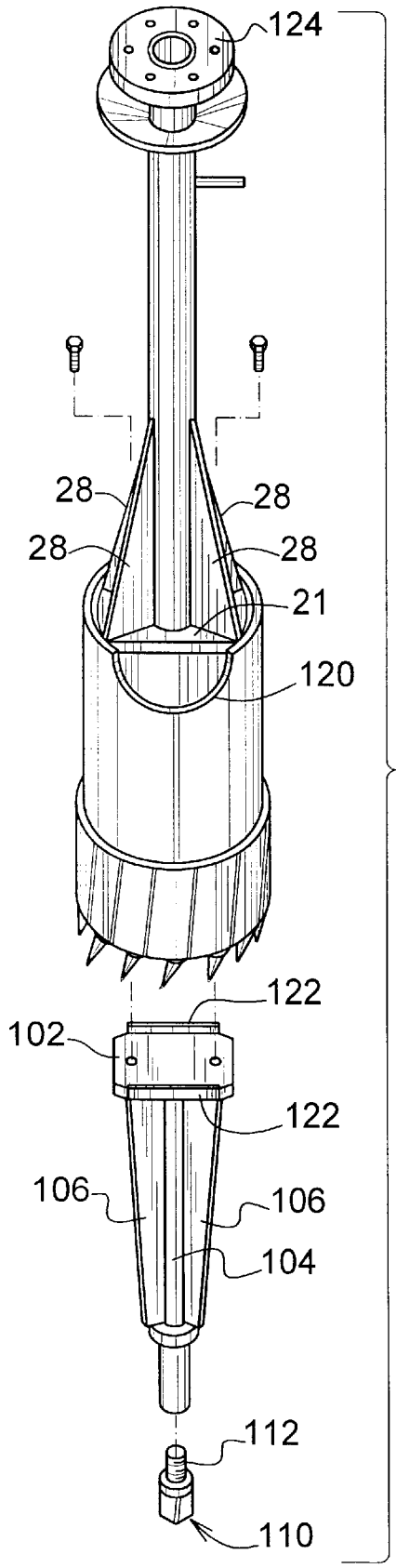
FIG. 14 is a perspective exploded view of the present invention shown in FIG. 9.

FIG. 14 shows the cutting head of the auger and the center drill bit of FIGS. 9–15 with the bottom of the base of the center drill bit including a pair of side flanges 122 for alignment and cooperative engagement with the side edges of the cross member 21 of the cutting head. Furthermore, the end view shows the edge of flanges 122 engaging the edge of the cross member 21.

The embodiment of the rock auger shown in FIGS. 9–21 have a connecting collar defining a flange 124 for connecting to a complimentary power drive flange and a protective flange circumscribing the shaft therebelow to protect the users. Of course the quick disconnect collar assembly as shown in described in FIGS. 1–8 can be used in place of the flange 124 on any of the embodiments described and shown in FIGS. 9–21. Moreover, the auger is operable and "floats" or is suspended on the substrate surface in a controllable manner even if the vertically disposed key way slot 34 is enlarged for providing additional "play".

FIGS. 16–21 show an alternate embodiment of the present invention wherein utilizes a 18 inch diameter cutting head with a cylindrical lower section 52 including from 13–18 teeth and an upper section 50 having a portion or section removed from the cylindrical body portion.

Figure 21:
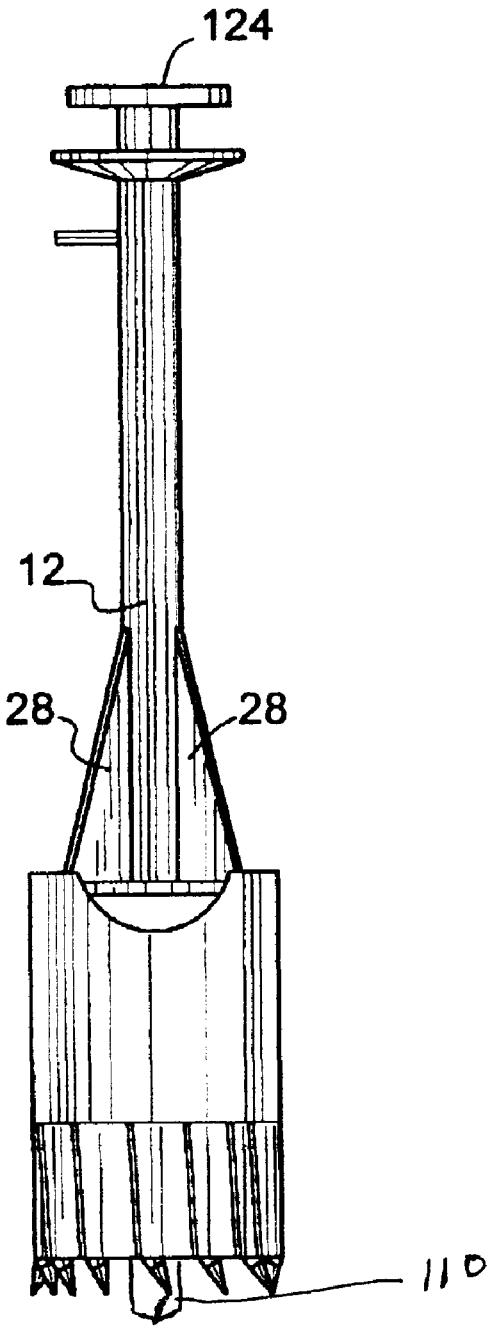
FIG. 21 is side view of the present invention shown in FIG. 16 including the pilot bit as shown in FIG. 9.

More particularly, the embodiment shown in FIGS. 16–20, includes one or more sections of the side wall of the cutting head 24 being removed from the cylindrical body forming the upper section. It is contemplated that the section not extend all the way from the cutting edge to the top of the cylindrical body and that even a portion of the cutting edge 52 could be removed. More than one section can be removed from the sidewall of the cutting head as well. However, a sufficient portion of the cutting edge must remain to support the teeth 44. The portion may be of uniform dimensions cut from top to bottom or preferably angled as shown in FIGS. 16–20. The preferred embodiment shown also includes a double wall wherein one of the walls forms an angled side edge along the longitudinal "lengthwise" dimension resulting in a side cutting edge; however, a single wall unit could have cutout portion formed with an angled sidewall edge as well. The embodiment shown in FIGS. 16–20 utilizes a cylindrical body having a diameter less than or equal to the diameter of the cutting edge 52. Removing a section of the sidewall forms the cutting edge to aid in removal of rock, dirt, or hard protruding objects from the sides of the hole providing a smooth surface. The unit shown in FIGS. 16–20 may also be used with a pilot bit as shown in FIG. 21, whereby the opening formed in the upper section extends from one corner of the cross member 21 which supports the base of the pilot bit to the adjacent comer of the cross member 21. The opposing sidewall could also be removed as long as the cutting head upper section retained sufficient structural strength so as not to buckle or collapse under a load. The bottom cutting edge section 52 usually provides enough suction and compression to maintain a plug within the top section. The upper or top section cutout portion may be designed to maximize the opening depending upon the rock and/or clay substrate. Of course, suction is not a problem when the cutting head is removed from the hole and the large opening provides ample space and facilitates quick and efficient removal of the substrate from the cutting head. The cutting side edges also trim and cut substrate along the sides of the drilling head forming a clean hole having uniform smoother sidewalls. The lower section of the cutting head need not extend outwardly at a greater diameter than the upper section of the cutting head when the side edges are utilized for cutting. Moreover, the outwardly and/or inwardly extending angle of the cutting teeth may be reduced or even eliminated when using the side cutting angle. The length or ratio of the upper and lower sections can also be customized for use in particular hard substrates. Finally it is contemplated that a number of smaller openings formed by holes, slots, or slits may be formed in the upper cylindrical body section of the drilling head as an alternate means to provide additional access to the substrate hole and provide drainage for water during the drilling process.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A rock auger comprising:

a cylindrical hollow cutting head for removing plugs of hard material from post holes comprising a hollow cylindrical body defining side walls connecting to an end plate, said hollow cylindrical body defining an upper peripheral edge and a lower open end defining a lower peripheral cutting edge including a plurality of removable teeth extending from said lower peripheral edge;

said end plate extending across said hollow cylindrical body joining said side walls and covering at least a portion thereof;

a drive shaft having a diameter less than said cutting head, said drive shaft including a proximal end connecting to a top surface of said end plate and having an opposing distal drive end extending therefrom;

means for connecting said distal drive end of said shaft to a drive shaft of a power unit; and a pilot drill bit including a pilot drill bit shaft and tip disposed within said cylindrical hollow cutting head, said pilot drill bit shaft mounting to a bottom surface of said mounting end plate.

2. A rock auger, comprising:

a cylindrical hollow cutting head comprising a hollow cylindrical body defining side walls connecting to an end plate, said hollow cylindrical body defining an upper peripheral edge and a lower open end defining a lower peripheral cutting edge including a plurality of teeth extending from said lower peripheral edge;

said end plate of said hollow cylindrical body extending across joining said side walls;

a drive shaft having a diameter less than said cutting head, said shaft including a proximal end connecting to a top surface of said end plate and having an opposing distal drive end extending therefrom;

means for connecting said distal end of said drive shaft to a power unit; and a pilot drill bit extending from a bottom surface of said end plate, said pilot drill bit including a drill bit shaft disposed within said cylindrical hollow cutting head and extending in axial alignment with said drive shaft; wherein at least a portion of a removable tip of said pilot drill bit extends pass said teeth extending from said lower peripheral edge of said cutting head and said pilot drill bit presenting an open area between said drill bit shaft and said hollow cylindrical body.

3. A rock auger, comprising:

a cylindrical hollow cutting head comprising a hollow cylindrical body defining side walls connecting to an end plate extending across an upper peripheral edge of said hollow cylindrical body and a lower open end defining a lower peripheral cutting edge including a plurality of teeth extending from said lower peripheral edge;

a drive shaft having a diameter less than said cutting head, said drive shaft including a proximal end connecting to a top surface of said end plate and having an opposing distal drive end extending therefrom; and a pilot drill extending from a bottom surface of said end plate, said pilot drill disposed within said cylindrical hollow cutting head and extending in axial alignment with said drive shaft;

said pilot drill comprising a pilot drill shaft and a removable tip; and said pilot drill extending pass said teeth extending from said lower peripheral edge of said cutting head.

4. A rock auger, comprising:

a cylindrical hollow cutting head comprising a hollow cylindrical body defining side walls connecting to an end plate extending across an upper peripheral edge of said hollow cylindrical body and a lower open end defining a lower peripheral cutting edge including a plurality of teeth extending from said lower peripheral edge;

said end plate including at least one opening therethrough;

a drive shaft having a diameter less than said cutting head, said drive shaft including a proximal end connecting to a top surface of said end plate and having an opposing distal drive end extending therefrom; and a pilot drill extending from a bottom surface of said end plate, said pilot drill disposed within said cylindrical hollow cutting head and extending in axial alignment with said drive shaft;

said pilot drill having a removable tip; and said pilot drill extending pass said teeth extending from said lower peripheral edge of said cutting head.

5. A rock auger, comprising:

a cylindrical hollow cutting head comprising a hollow cylindrical body defining side walls connecting to an end plate extending across an upper peripheral edge enclosing at least a portion of said hollow cylindrical body, and a lower open end defining a lower peripheral cutting edge including a plurality of teeth extending from said lower peripheral edge;

a drive shaft having a diameter less than said cutting head, said drive shaft including a proximal end connecting to a top surface of said end plate and said drive shaft having an opposing distal drive end extending therefrom; and a pilot drill extending from a bottom surface of said end plate, said pilot drill disposed within said cylindrical hollow cutting head and extending in axial alignment with said drive shaft, said pilot drill having a removable tip; and said pilot drill extending pass said teeth extending from said lower peripheral edge of said cutting head.

6. A rock auger, comprising:

a cylindrical hollow cutting head comprising a hollow cylindrical body defining side walls connecting to an end plate extending across an upper peripheral edge enclosing at least a portion of a top end of said hollow cylindrical body, and a lower open end defining a lower peripheral cutting edge including a plurality of teeth extending from said lower peripheral edge;

said side walls of said hollow cylindrical body including at least one opening therein;

a drive shaft having a diameter less than said cutting head, said drive shaft including a proximal end connecting to a top surface of said end plate and having an opposing distal drive end extending therefrom; and a pilot drill extending from a bottom surface of said end plate, said pilot drill disposed within said cylindrical hollow cutting head and extending in axial alignment with said drive shaft, said pilot drill having a removable tip; and said pilot drill extending pass said teeth extending from said lower peripheral edge of said cutting head.

7. A rock auger, comprising:

a cylindrical hollow cutting head comprising a hollow cylindrical body defining side walls connecting to an end plate extending across an upper peripheral edge enclosing at least a portion of a top end of said hollow cylindrical body, and a lower open end defining a lower peripheral cutting edge including a plurality of teeth extending from said lower peripheral edge;

a drive shaft having a diameter less than said cutting head, said drive shaft including a proximal end connecting to a top surface of said end plate and having an opposing distal drive end extending therefrom; and a pilot drill extending from a bottom surface of said end plate, said pilot drill disposed within said cylindrical hollow cutting head and extending in axial alignment with said drive shaft;

said pilot drill comprising a longitudinal member defining a pilot drill shaft attaching to a base plate secured to said end plate within said hollow cylindrical body, and including at least one reinforcing member extending from said base plate attaching to at least one selected point of said pilot drill shaft.

8. A rock auger, comprising:

a cylindrical hollow cutting head comprising a hollow cylindrical body defining side walls connecting to an end plate extending across an upper peripheral edge enclosing at least a portion of said end plate of said hollow cylindrical body, said cylindrical hollow cutting head having a lower open end defining a lower peripheral cutting edge including a plurality of teeth projecting from said lower peripheral cutting edge;

a drive shaft having a diameter less than said cutting head, said drive shaft including a proximal end connecting to a top surface of said end plate and having an opposing distal drive end extending therefrom;

a pilot drill disposed within said hollow cylindrical body, said pilot drill comprising a shaft including a proximal end mounting to a bottom surface of said end plate and a distal end including a pilot drill tip extending outwardly past said teeth projecting from said lower peripheral cutting edge; and means for reinforcing said pilot drill extending from said bottom surface of said end plate to said pilot drill shaft.

9. A rock auger, comprising:

a cylindrical hollow cutting head comprising a hollow cylindrical body defining side walls connecting to an end plate extending across an upper peripheral edge enclosing at least a portion of said hollow cylindrical body, said cylindrical hollow cutting head having a lower open end defining a lower peripheral cutting edge including a plurality of teeth projecting from said lower peripheral cutting edge;

a drive shaft having a diameter less than said cutting head, said drive shaft including a proximal end connecting to a top surface of said end plate and having an opposing distal drive end extending therefrom; and a pilot drill comprising a pilot drill shaft disposed within said hollow cylindrical body, said pilot drill shaft including a proximal end mounting to a bottom surface of said end plate and a distal end defining a drill tip extending outwardly past said lower peripheral cutting edge.

10. The rock auger of claim 9, including means for reinforcing and bracing said pilot drill shaft mounting to said bottom surface of said end plate.

11. The rock auger of claim 10, wherein said means for reinforcing and bracing said pilot drill shaft comprises at least one reinforcing member extending from said bottom surface of said mounting end plate and attaching to at least one selected point of said pilot drill shaft.

12. The rock auger of claim 11, wherein said means for reinforcing and bracing said pilot drill shaft comprises a plurality of tapered support plates having a broad base extending from said bottom surface of said mounting end plate and a tapered end attaching to said selected point of said pilot drill shaft.

13. The rock auger of claim 12, wherein said tapered support plates are welded all along the edge to said pilot drill shaft extending to a point near said drill tip.

14. The rock auger of claim 9, wherein said distal end of said pilot drill shaft ends in a short cylindrical collar including means for removably attaching said drill tip.

15. The rock auger of claim 9, including at least one reinforcing member extending from said top surface of said end plate to said drive shaft.

16. The rock auger of claim 9, including at least one opening within said hollow cylindrical body extending between said lower peripheral cutting edge and said end plate.

17. A rock auger, comprising:

a cylindrical hollow cutting head comprising a hollow cylindrical body defining side walls connecting to an end plate extending across an upper peripheral edge enclosing at least a portion of said end plate of said hollow cylindrical body, said cylindrical hollow cutting head having a lower open end defining a lower peripheral cutting edge including a plurality of teeth projecting from said lower peripheral cutting edge;

a drive shaft having a diameter less than said cutting head, said drive shaft including a proximal end connecting to a top surface of said end plate and having an opposing distal drive end extending therefrom;

at least one opening within said hollow cylindrical body extending between said lower peripheral cutting edge and said end plate; and a pilot drill comprising a pilot drill shaft disposed within said hollow cylindrical body, said pilot drill shaft including a proximal end mounting to a bottom surface of said end plate and a distal end defining a drill tip.

18. A rock auger, comprising:

a cylindrical hollow cutting head comprising a hollow cylindrical body defining side walls connecting to an end plate extending across an upper peripheral edge enclosing at least a portion of said end plate of said hollow cylindrical body, said cylindrical hollow cutting head having a lower open end defining a lower peripheral cutting edge including a plurality of teeth projecting from said lower peripheral cutting edge;

means for driving said cutting head extending from a top surface of said mounting end plate;

at least one opening within said hollow cylindrical body extending between said lower peripheral cutting edge and said mounting end plate; and a pilot drill comprising a pilot drill shaft disposed within said hollow cylindrical body, said pilot drill shaft having a diameter less than said cutting head, said pilot drill shaft including a proximal end mounting to a bottom surface of said end plate and a distal end defining a drill tip extending below said lower peripheral cutting edge.

19. A rock auger, comprising:

a cylindrical hollow cutting head comprising a hollow cylindrical body defining side walls connecting to an end plate extending across an upper end thereof enclosing at least a portion of said hollow cylindrical body, said cylindrical hollow cutting head having a lower open end defining a lower peripheral cutting edge including a plurality of teeth projecting from said lower peripheral cutting edge;

means for driving said cutting head extending from a top surface of said end plate;

a pilot drill comprising a pilot drill shaft disposed within said hollow cylindrical body including a proximal end mounting to a bottom surface of said end plate and a distal end comprising a drill tip extending below said lower peripheral cutting edge.

20. The rock auger of claim 19, including at least one opening within said side walls of said hollow cylindrical body, said at least one opening extending between said lower peripheral cutting edge and said end plate.

21. The rock auger of claim 19, wherein said means for driving comprises a drive shaft having a diameter less than said cutting head, said drive shaft including a proximal end connecting to said top surface of said end plate and having an opposing distal drive end extending therefrom.

22. The rock auger of claim 19, wherein said teeth are removable.

23. The rock auger of claim 22, wherein said teeth are mounted into angled sockets mounted by welding onto a bottom surface of said lower peripheral cutting edge.

24. The rock auger of claim 21, said distal drive end including a quick disconnect assembly.

25. The rock auger of claim 19, wherein said teeth are conical.

26. The rock auger of claim 19, wherein said teeth are oriented in a staggered configuration with said teeth angling forward at an angle up to 75 degrees.

27. The rock auger of claim 19, wherein said teeth are oriented in a staggered configuration with said teeth angling forward at an angle of 35 degrees.

28. The rock auger of claim 27, wherein every third tooth of said teeth is angled up to 30 degrees in the horizontal plane inwardly or outwardly pass said lower peripheral cutting edge.

29. The rock auger of claim 19, including means of reinforcing said pilot drill bit extending from said bottom surface of said end plate to a point near said drill tip.

30. The rock auger of claim 29, wherein said means of reinforcing comprises at least one tapered support plate.

31. The rock auger of claim 30, wherein said means of reinforcing comprises a plurality of tapered support plates extending from said bottom surface of said end plate and connecting to at least one point along said pilot drill shaft ending in a cylindrical collar including a threaded bore for cooperative engagement of said drill tip.

32. The rock auger of claim 19, including means of reinforcing said drive shaft extending from said top surface of said end plate to a selected point along said drive shaft.

33. The rock auger of claim 32, wherein said means of reinforcing comprises at least one tapered support plate.

* * * * *